US005697809A

United States Patent [19]

Chung

[11] Patent Number: 5,697,809

[45] Date of Patent: Dec. 16, 1997

[54] NETWORK HUB WITH CABLE HOLDER MEANS

[75] Inventor: Ming-Tsai Chung, Taipei Hsien, Taiwan

[73] Assignee: D-Link Corporation, Hsinchu, Taiwan

[21] Appl. No.: 658,214

[22] Filed: Jun. 4, 1996

[51] Int. Cl.[6] ..... H01R 13/72

[52] U.S. Cl. ..... 439/501; 439/471; 174/129 B

[58] Field of Search ..... 439/471, 464, 439/449, 501, 4; 174/129 R, 129 A, 129 B, 130

[56] References Cited

U.S. PATENT DOCUMENTS 5,364,289 11/1994 Noguchi et al. ..... 439/501

*Primary Examiner*—Gary F. Pauman
*Attorney, Agent, or Firm*—Bacon & Thomas

[57] ABSTRACT

A network hub having a recessed portion on the front panel thereof, and a L-shaped cable holder pivotably connected to the recessed portion, wherein the L-shaped cable holder can be turned between the operative position in which network cables can be hung on the L-shaped cable holder and fixed thereto by a binding strap, and the non-operative position in which the L-shaped cable holder is closed on the recessed portion.

8 Claims, 4 Drawing Sheets

NETWORK HUB WITH CABLE HOLDER MEANS

BACKGROUND OF THE INVENTION

The present invention relates to network hubs, and relates more particularly to such a network hub which has at least one L-shaped cable holder pivoted to the front panel thereof, that can be turned between the non-operative position closed on a recessed portion on the front panel and the operative position for holding network cables in good order.

A regular hub, such as a vertical network hub, as shown in FIG. 1, comprises a casing (90) having a longitudinal series of connector sockets (91) at one side, and a base (92) at the bottom of the casing (90). The base (92) has two upright rods (93) adapted for keeping network cables in therebetween. Because the upright rods (93) are disposed outside the casing (90), the size of the base (92) must be bigger than that of the casing (90). This design needs much installation space. Further, the upright rods 93 tend to be damaged during the delivery of the network hub.

SUMMARY OF THE INVENTION

The present invention has been accomplished to provide a network hub which eliminates the aforesaid drawbacks. According to one aspect of the present invention, the network hub comprises at least one recessed portion on the front panel thereof, and at least one L-shaped cable holder respectively and pivotably connected to the at least recessed portion, wherein each L-shaped cable holder can be turned between the operative position outside the respective recessed portion for holding network cables in good order, and the non-operative position inside the respective recessed portion. According to another aspect of the present invention, each L-shaped cable holder comprises at least one wire hole, and one cable binding strap mounted in the at least one wire hole for binding up network cables. According to still another aspect of the present invention, each L-shaped cable holder has a corrugated portion at an inner side for keeping network cables in place. According to still another aspect of the present invention, each L-shaped cable holder has a plurality of transverse ribs at an outer side for pushing by hand to move the respective cable holder out of the respective recessed portion.

DETAILED DESCRIPTION OF THE PREFERRED EMBODIMENT

Figure 1:
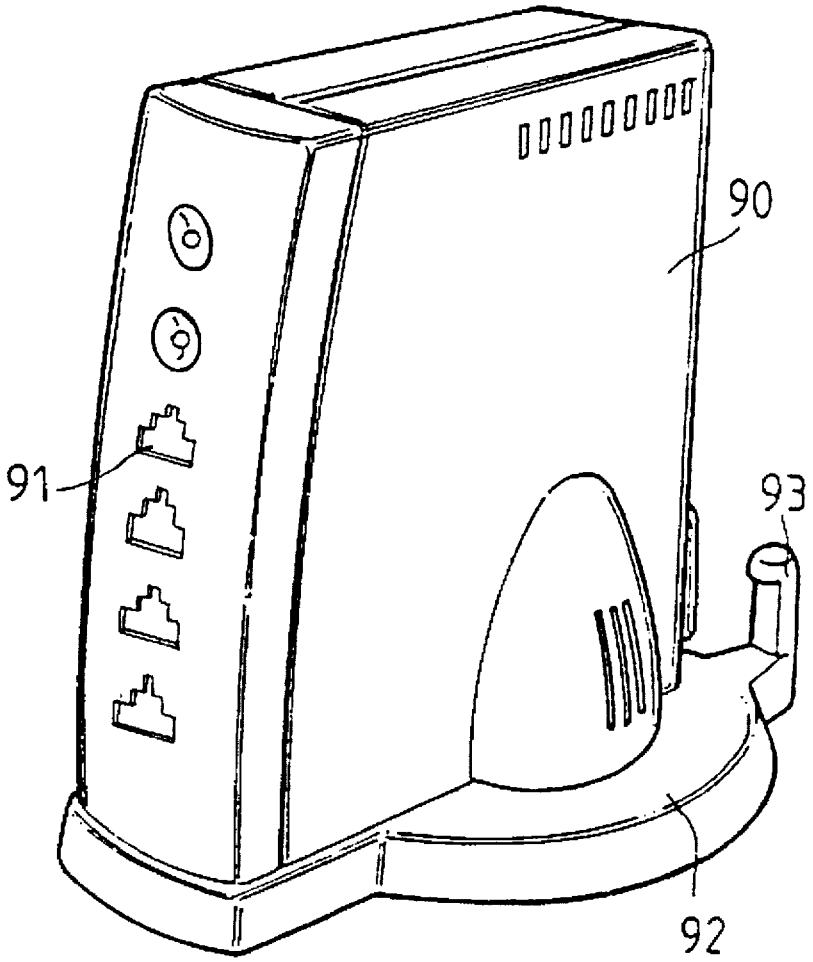
FIG. 1 prior art
FIG. 1 is an elevational view of a vertical type network hub according to the prior art.
Figure 2:
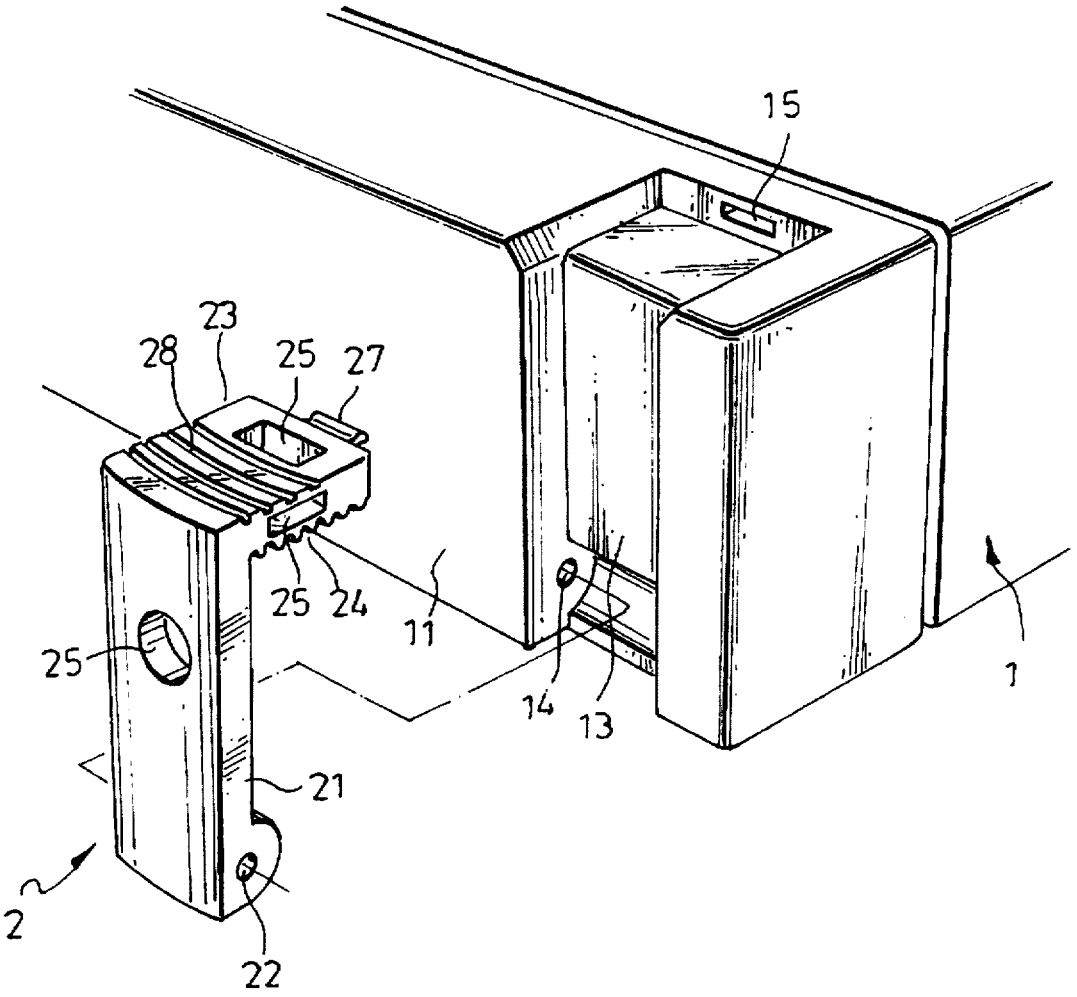
FIG. 2 is an exploded view of the preferred embodiment of the present invention.
Figure 3:
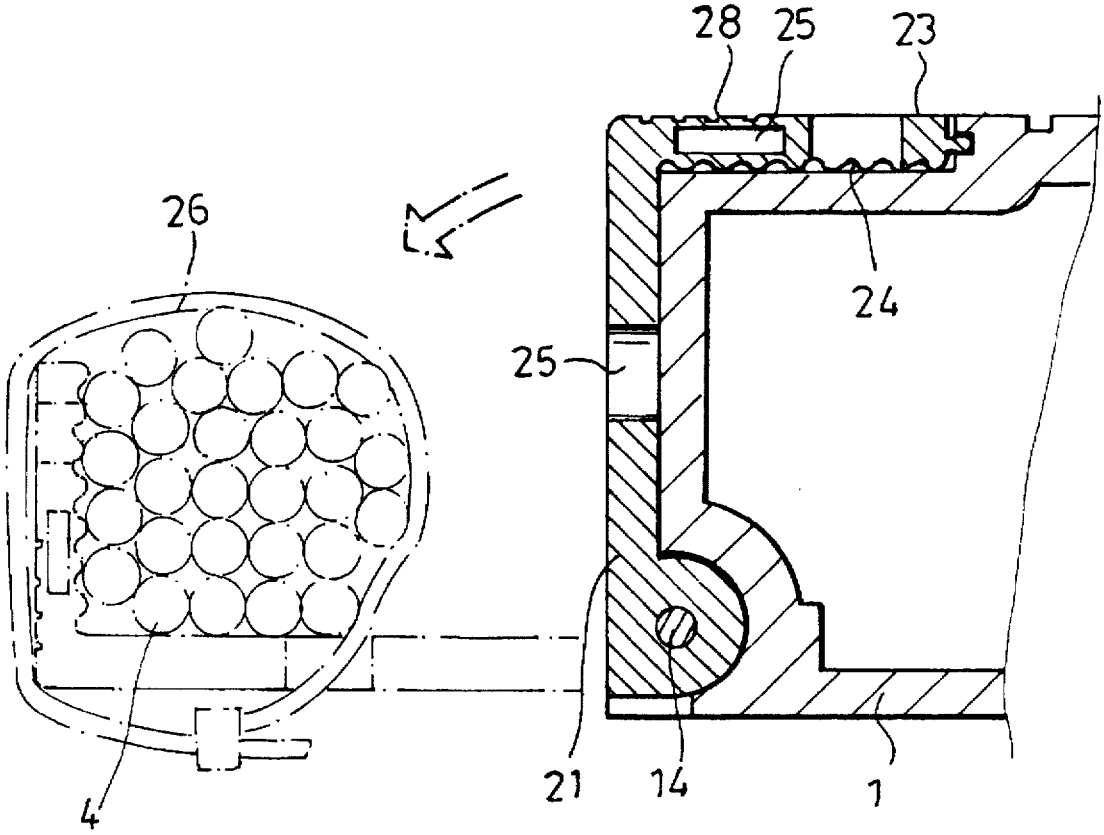
FIG. 3 is an applied view of the preferred embodiment of the present invention.
Figure 4:
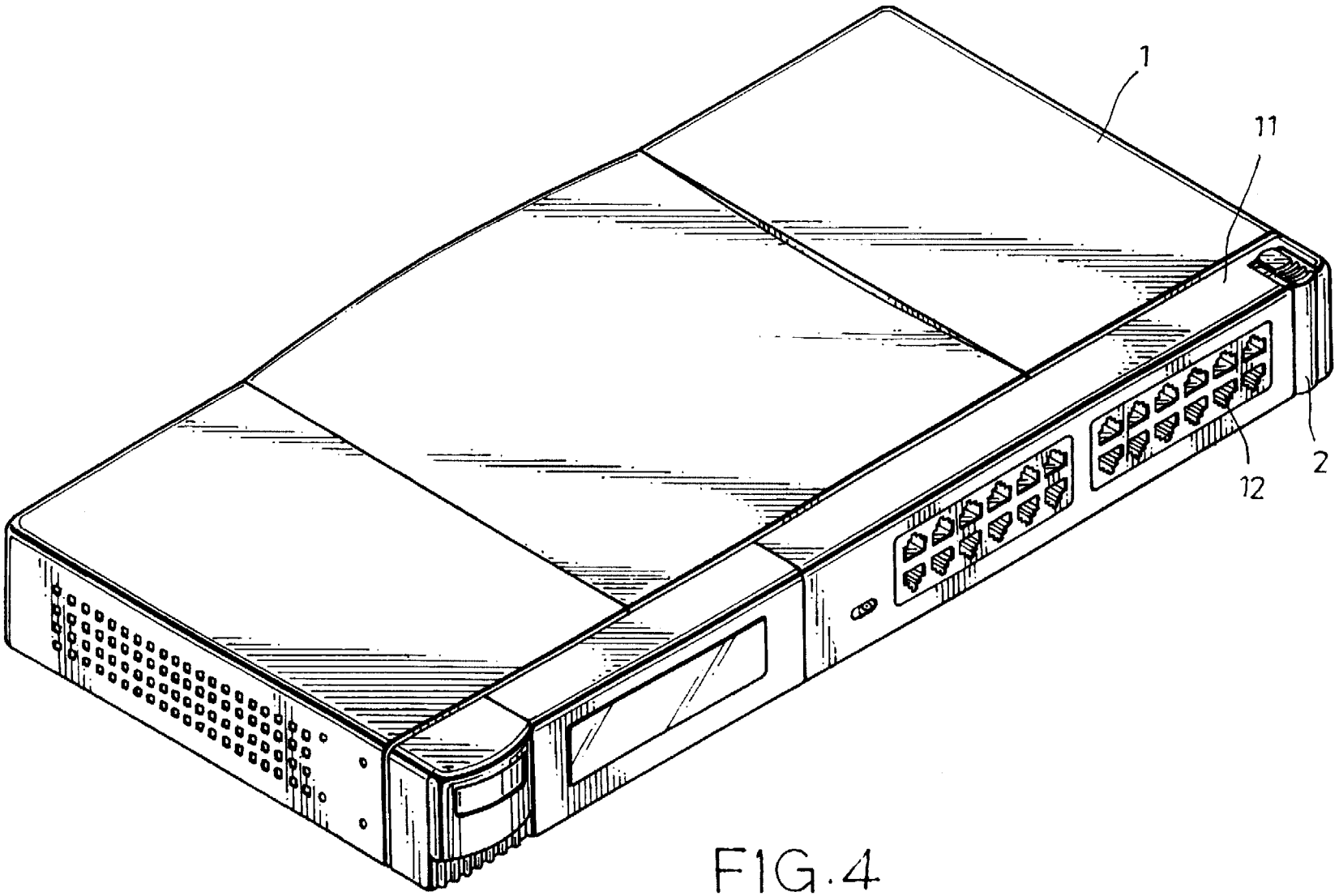
FIG. 4 is an elevational view of the preferred embodiment of the present invention.

Referring to FIGS. 2 and 4, the present invention comprises a hub 1, and a substantially L-shaped cable holder 2. The hub 1 can be a horizontal or vertical type (the embodiment shown in the drawings is a horizontal hub), having a front panel 11 at one side, a plurality of connector sockets 12 mounted on the front panel 11. The front panel 11 has a recessed portion 13 adjacent to the connector sockets 12, and two coupling means 14 (for example, stub rods). The L-shaped cable holder 2 is pivotably mounted in the recessed portion 13, comprised of a horizontal wall 21 and a vertical wall 23 connected at right angles. The horizontal wall 21 has two coupling means 22 (for example, pivot holes) bilaterally disposed at one end remote from the vertical wall 23 and pivotably coupled to the coupling means 14 of the front panel 11 of the hub 1. Therefore, the L-shaped cable holder 2 can be turned about the coupling means 14 of the front panel 11, and moved in and out of the recessed portion 13. The vertical wall 23 has a corrugated portion 24 at an inner side adapted for keeping network cables 4 in place (see also FIG. 3). Wire holes 25 are made on the horizontal wall 21 and the vertical wall 23 for the mounting of a cable binding strap 26. A retaining hole 15 is made in the recessed portion 13 of the front panel 11 near the top. The vertical wall 23 of the L-shaped cable holder 2 has a hooked projection 27, which is forced into engagement with the retaining hole 15 when the L-shaped cable holder 2 is closed on the recessed portion 13. The vertical wall 23 of the L-shaped cable holder 2 has plurality of transverse ribs 28 at an outer side through which the L-shaped cable holder 2 can be pushed outwards by hand to disconnect the hooked portion 27 from the retaining hole 15.

Referring to FIGS. 2, 3, and 4, the L-shaped cable holder 2 can be turned out of the recessed portion 13 of the front panel 11 of the hub 1 by pushing the transverse ribs 28 outwards by hand to disconnect the hooked portion 27 from the retaining hole 15. When the L-shaped cable holder 2 is turned out of the recessed portions 13 of the front panel 11 of the hub 1, the network cables 4 which are respectively connected to the connector sockets 12 of the hub 1 are gathered together and hung on the L-shaped cable holder 2 within the space defined between the L-shaped cable holder 2 and the front panel 11 of the hub 1, and then the cable binding strap 26 is inserted through the holes 25 and mounted around the network cables 4 to hold the network cables 4 in place. When the network cables 4 are disconnected from the hub 1, the L-shaped cable holder 2 is turned upwards and pushed into the recessed portion 13 of the front panel 11 of the hub. When the L-shaped cable holder 2 is closed on the recessed portion 13, the hooked portion 27 is forced into engagement with the retaining hole 15 to hold the L-shaped cable holder 2 in the closed position.

While only one embodiment of the present invention has been shown and described, it will be understood that various modifications and changes could be made without departing from the spirit and scope of the invention disclosed.

What the invention claimed is:

1. A network hub of the type comprising a front panel and a plurality of connector sockets for the connection of network cables, the improvement comprising at least one recessed portion respectively made on said front panel said at least one recessed portion having respective first coupling means, and at least one cable holder respectively and pivotably coupled to the first coupling means of said at least one recessed portions and turned between a first position closed on said at least one recessed portion and a second position moved out of said at least one recessed portion, each of said at least one cable holder comprising a first wall and a second wall connected at right angles, said first wall having one end fixedly mounted with second coupling means pivoted to the first coupling means of the respective recessed portion and an opposite end connected to said second wall.

2. The network hub of claim 1 wherein the first coupling means of each of said at least one recessed portion is comprised of at least one pivot about which said cable holder turns.

3. The network hub of claim 1 wherein the second coupling means of each of said at least one cable holder is comprised of two pivot holes respectively coupled to the first coupling means of the respective recessed portion.

4. The network hub of claim 1 wherein each of said at least one cable holder has at least one wire hole adapted for the insertion of a cable binding strap for fastening network cables.

5. The network hub of claim 4 wherein each of said at least one cable holder comprises a cable binding strap inserted in the wire hole thereof for fastening network cables.

6. The network hub of claim 1 wherein the second wall of each of said at least one cable holder has a corrugated portion at an inner side for keeping network cables in place.

7. The network hub of claim 1 wherein each of said at least one recessed portion has a retaining hole remote from the respective first coupling means; the second wall of each of said at least one cable holder has a hooked portion raised from one end thereof remote from the respective first wall and adapted for engaging the retaining hole of the respective recessed portion when the respective cable holder is closed on the respective recessed portion.

8. The network hub of claim 1 wherein the second wall of each of said at least one cable holder has a plurality of transverse ribs at an outer side for pushing by hand to move the respective cable holder out of the respective recessed portion.

* * * * *